US011583024B2

(12) United States Patent
Rietdyk

(10) Patent No.: US 11,583,024 B2
(45) Date of Patent: Feb. 21, 2023

(54) HELMET FIT SYSTEM

(71) Applicant: LIFT Airborne Technologies LLC, Rancho Dominguez, CA (US)

(72) Inventor: Guido Rietdyk, Rolling Hills, CA (US)

(73) Assignee: LIFT Airborne Technologies LLC, Rancho Dominguez, CA (US)

( * ) Notice: Subject to any disclaimer, the term of this patent is extended or adjusted under 35 U.S.C. 154(b) by 225 days.

(21) Appl. No.: 17/115,149

(22) Filed: Dec. 8, 2020

(65) Prior Publication Data

US 2022/0175074 A1 Jun. 9, 2022

(51) Int. Cl.
*A42B 3/14* (2006.01)
*A42B 3/08* (2006.01)

(52) U.S. Cl.
CPC ..... *A42B 3/08* (2013.01); *A42B 3/145* (2013.01)

(58) Field of Classification Search
CPC ..... A42B 3/145; A42B 3/08; A42B 3/324
See application file for complete search history.

(56) References Cited

U.S. PATENT DOCUMENTS

| | | | | |
|---|---|---|---|---|
| RE32,569 | E | 1/1988 | Aileo et al. | |
| 6,256,798 | B1 | 7/2001 | Egolf et al. | |
| 8,032,993 | B2 | 10/2011 | Musal | |
| 9,179,729 | B2 | 11/2015 | Cotterman et al. | |
| 10,420,385 | B2 | 9/2019 | Lakes et al. | |
| 10,588,374 | B2 | 3/2020 | Maloney | |
| RE48,048 | E | 6/2020 | Belanger et al. | |
| 2004/0117897 | A1* | 6/2004 | Udelhofen | A42B 3/324 2/421 |
| 2005/0204456 | A1* | 9/2005 | Piper | A42B 3/00 2/411 |
| 2009/0031482 | A1 | 2/2009 | Stokes et al. | |
| 2013/0067643 | A1 | 3/2013 | Musal et al. | |
| 2013/0239303 | A1 | 9/2013 | Cotterman et al. | |
| 2013/0312163 | A1 | 11/2013 | Van Waes | |
| 2016/0165998 | A1* | 6/2016 | Musal | A42B 3/145 2/417 |
| 2017/0006951 | A1 | 1/2017 | Venturini et al. | |

(Continued)

FOREIGN PATENT DOCUMENTS

| | | |
|---|---|---|
| AU | 2014342635 B2 | 5/2015 |
| CN | 202819762 U | 3/2013 |

(Continued)

OTHER PUBLICATIONS

Partial European search report dated Apr. 26, 2022, in European Patent Application No. 21213115.5, 13 pages.

(Continued)

*Primary Examiner* — Tajash D Patel
(74) *Attorney, Agent, or Firm* — Lowe Graham Jones PLLC

(57) ABSTRACT

A helmet fit system includes a harness, a first anchor and a second anchor secured to a helmet, a tensioning mechanism, and a cable passing from the mechanism, around the first anchor, through the harness, and around the second anchor. The tensioning mechanism is not secured to any portion of the harness. The harness may define a channel, the cable passing through the channel. The tensioning mechanism is mounted to the outer surface of a helmet on the first side of a plane of symmetry of the helmet such that the cable passes through the helmet.

18 Claims, 7 Drawing Sheets

(56) References Cited

U.S. PATENT DOCUMENTS

| | | | | |
|---|---|---|---|---|
| 2017/0055623 | A1* | 3/2017 | Pritz | A42B 3/142 |
| 2017/0095028 | A1 | 4/2017 | Musal et al. | |
| 2017/0143070 | A1 | 5/2017 | Cram et al. | |
| 2018/0325203 | A1* | 11/2018 | Cotterman | A42B 3/06 |

FOREIGN PATENT DOCUMENTS

| | | | |
|---|---|---|---|
| CN | 105876964 | A | 8/2016 |
| EP | 1708587 | B1 | 4/2008 |
| EP | 2095729 | A1 | 9/2009 |
| WO | 2019/214960 | | 11/2019 |

OTHER PUBLICATIONS

Isofit Custom Helmet Fit System; https://competition.adesignaward.com/design-image.php?y=2017&design=62360; accessed Sep. 3, 2020; 6 pages.

M2 Helmet 2019; https://7protection.com/gb/product/m2-helmet-2019/; accessed Sep. 3, 2020; 6 pages.

Extended European search report dated Aug. 9, 2022, in European Patent Application No. 21213115.5, 13 pages.

* cited by examiner

HELMET FIT SYSTEM

FIELD OF THE INVENTION

This application relates to helmets, and, more particularly, to adjustable fit systems for helmets.

BACKGROUND OF THE INVENTION

Although helmets may be made in various sizes, it is impractical to make a helmet for every head size. This is particularly the case for highly-specialized helmets, such as those used by fighter jet pilots. Accordingly, many helmets incorporate some form of fit adjustment. In modern helmets, this may take the form of an inner yoke or flexible frame with one or more parts that may be adjusted in length, such as with an adjustment wheel. Fit is important for comfort and for helmet stability, especially when used with helmet attachments such as various optics.

It would be an advancement in the art to improve the functioning of an adjustable helmet.

SUMMARY OF THE INVENTION

In one aspect of the invention, a helmet fit system may be mounted in a helmet and include: a harness; a first anchor; a second anchor; a tensioning mechanism; and a cable passing from a first point of securement on the tensioning mechanism, around the first anchor, through the harness, and around the second anchor. The tensioning mechanism is not secured to any portion of the harness. The harness may define a channel, the cable passing through the channel. The channel may be defined by a cover plate secured over a portion of the harness. The tensioning mechanism may be a dial tensioner. In some embodiments, the cable further passes from the second anchor, back through the harness, around the first anchor to a second point of securement on the tensioning mechanism. The harness may be adapted to conform to a head of a wearer of the helmet. The harness may define a plurality of webs defining one or more openings. In some embodiments, the helmet fit system includes a fastening strip defining a plurality of fastening points, the harness being configured to secure to any of the fastening points.

In another aspect of the invention, a helmet is adapted to secure around a head of a wearer and has an inner surface and an outer surface, the helmet defining a plane of symmetry. A helmet fit system is mounted to the helmet, the helmet fit system including: a harness; a first anchor mounted to the inner surface of the helmet on a first side of the plane of symmetry; a second anchor mounted to the inner surface of the helmet on a second side of the plane of symmetry opposite the first side; a tensioning mechanism mounted to the outer surface of the helmet on the first side of the plane of symmetry; and a cable passing from a first point of securement on the tensioning mechanism, around the first anchor, through the harness, and around the second anchor. In some embodiments, the tensioning mechanism is a dial tensioner.

In some embodiments, the helmet defines a channel defined between the inner surface and the outer surface and offset from the plane of symmetry, the cable passing from the first point of securement on the tensioning mechanism, through the channel, and around the first anchor.

In some embodiments, the cable further passes from the second anchor, back through the harness, around the first anchor, through the channel, and to a second point of securement on the tensioning mechanism.

In some embodiments, the tensioning mechanism is offset from the plane of symmetry by at least 15 percent of a width of the helmet perpendicular to the plane of symmetry. In some embodiments, the tensioning mechanism is offset from the plane of symmetry by at least 20 percent of a width of the helmet perpendicular to the plane of symmetry.

In some embodiments, the harness defines a channel, the cable passing through the channel. The channel may be defined by a cover plate secured over a portion of the harness. The harness may be adapted to conform to a head of a wearer of the helmet. The harness may define a plurality of webs defining one or more openings. A fastening strip defining a plurality of fastening points may be secured to the inner surface of the helmet, the harness being configured to secure to any of the fastening points. The tensioning mechanism is not secured to harness by any structure other than the cable and the helmet.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
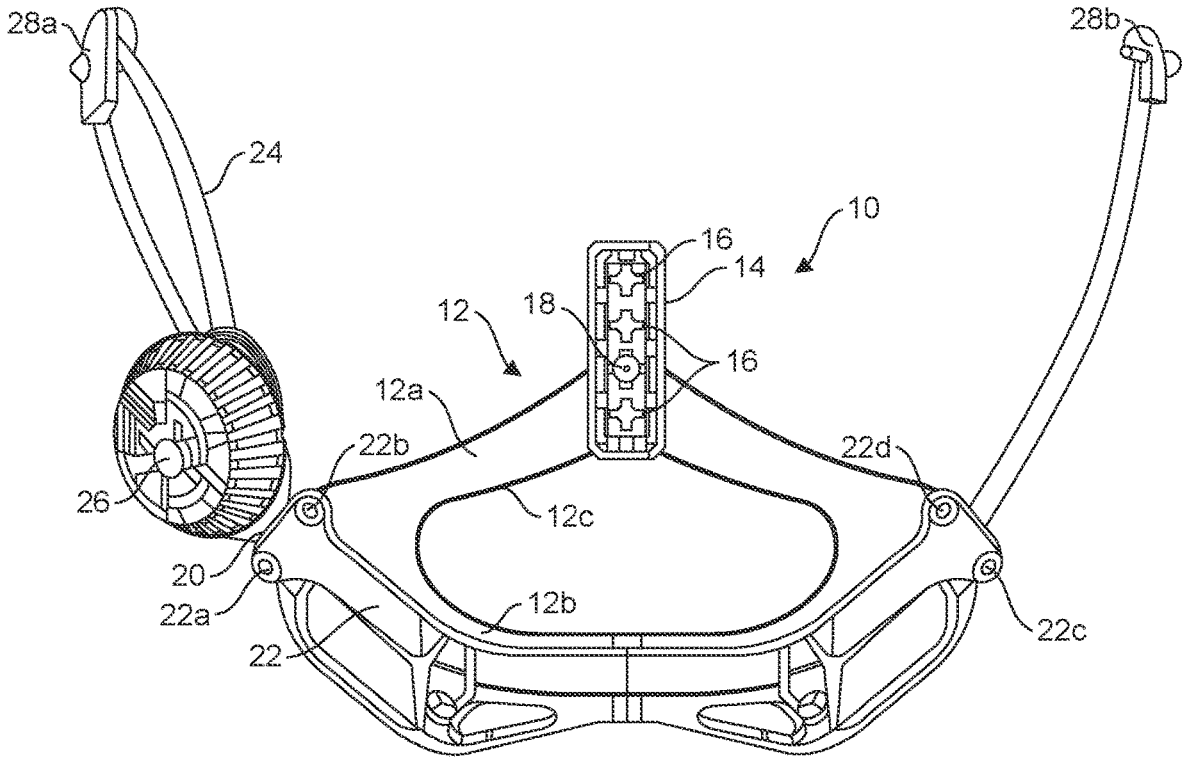
FIG. 1 is a rear isometric view of a helmet fit system in accordance with an embodiment of the present invention.
Figure 2:
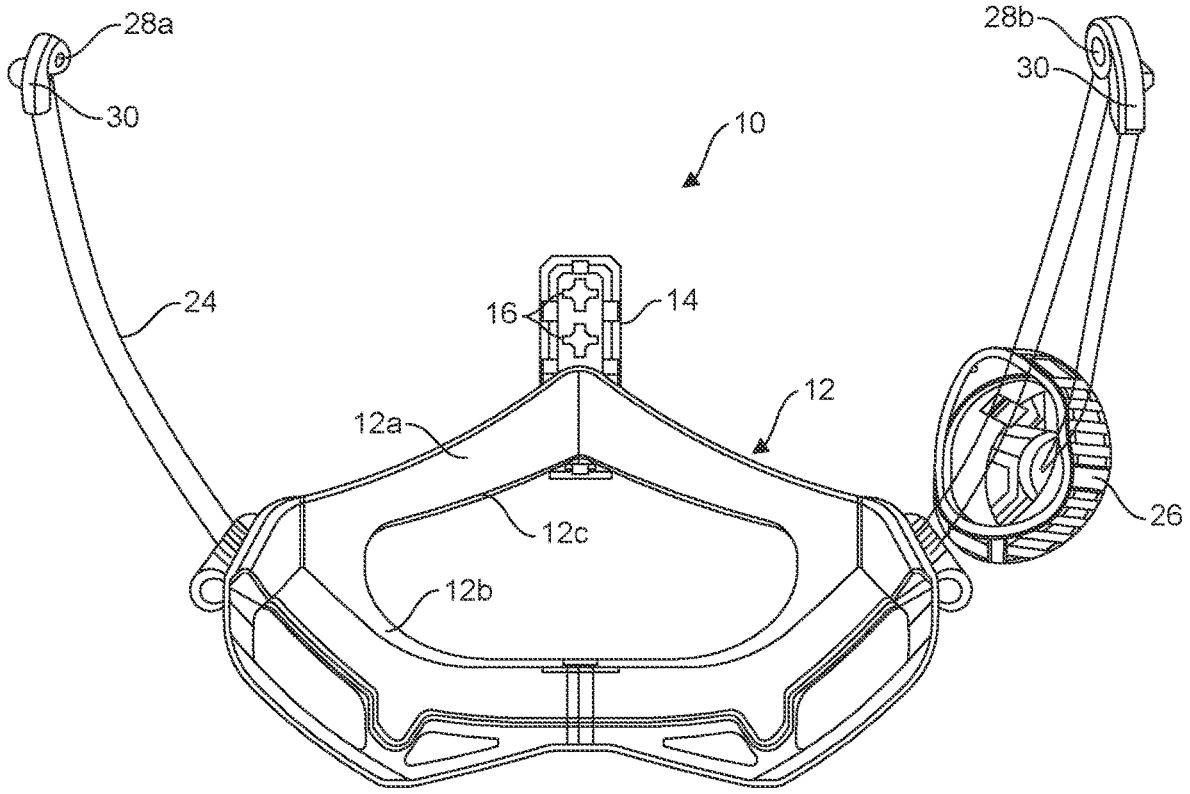
FIG. 2 is a front isometric view of the helmet fit system in accordance with an embodiment of the present invention.
Figure 3:
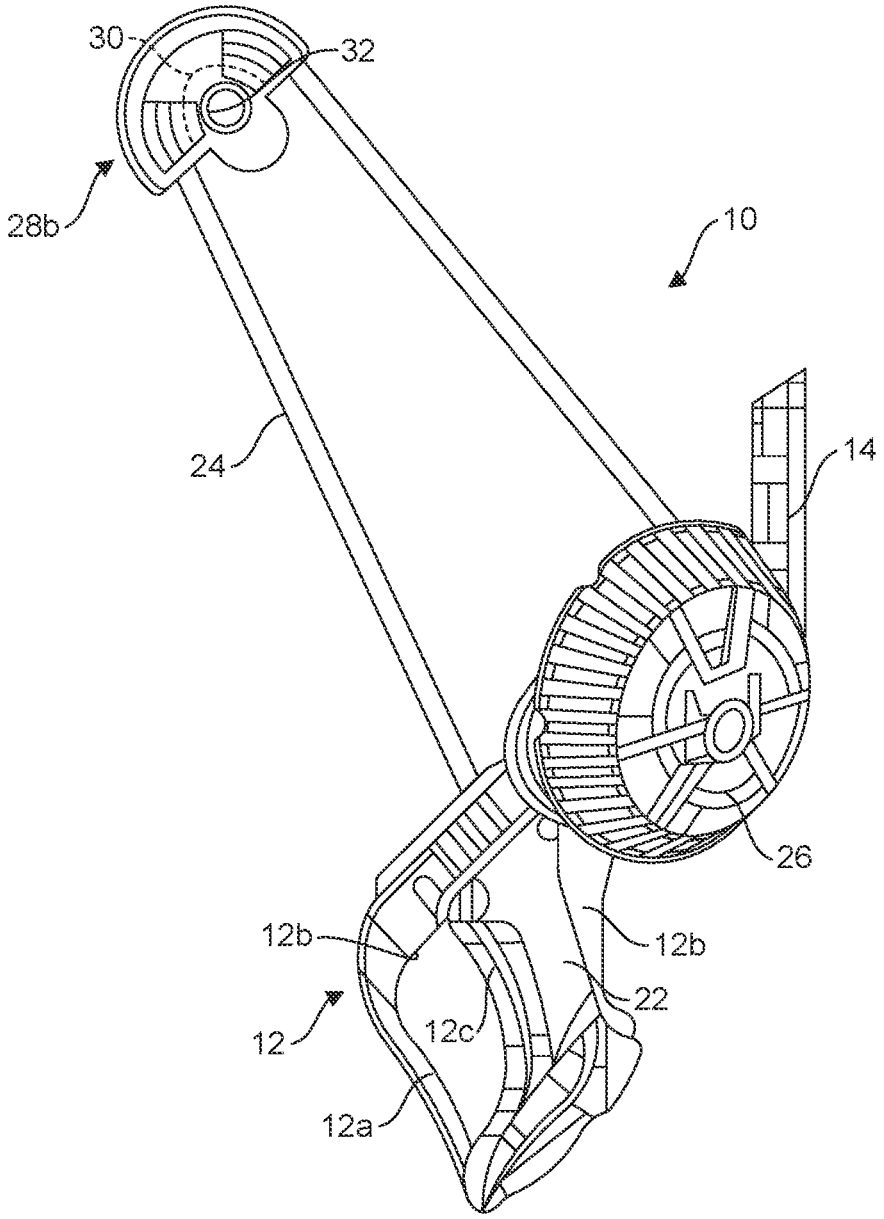
FIG. 3 is a side view of the helmet fit system in accordance with an embodiment of the present invention.
Figure 4:
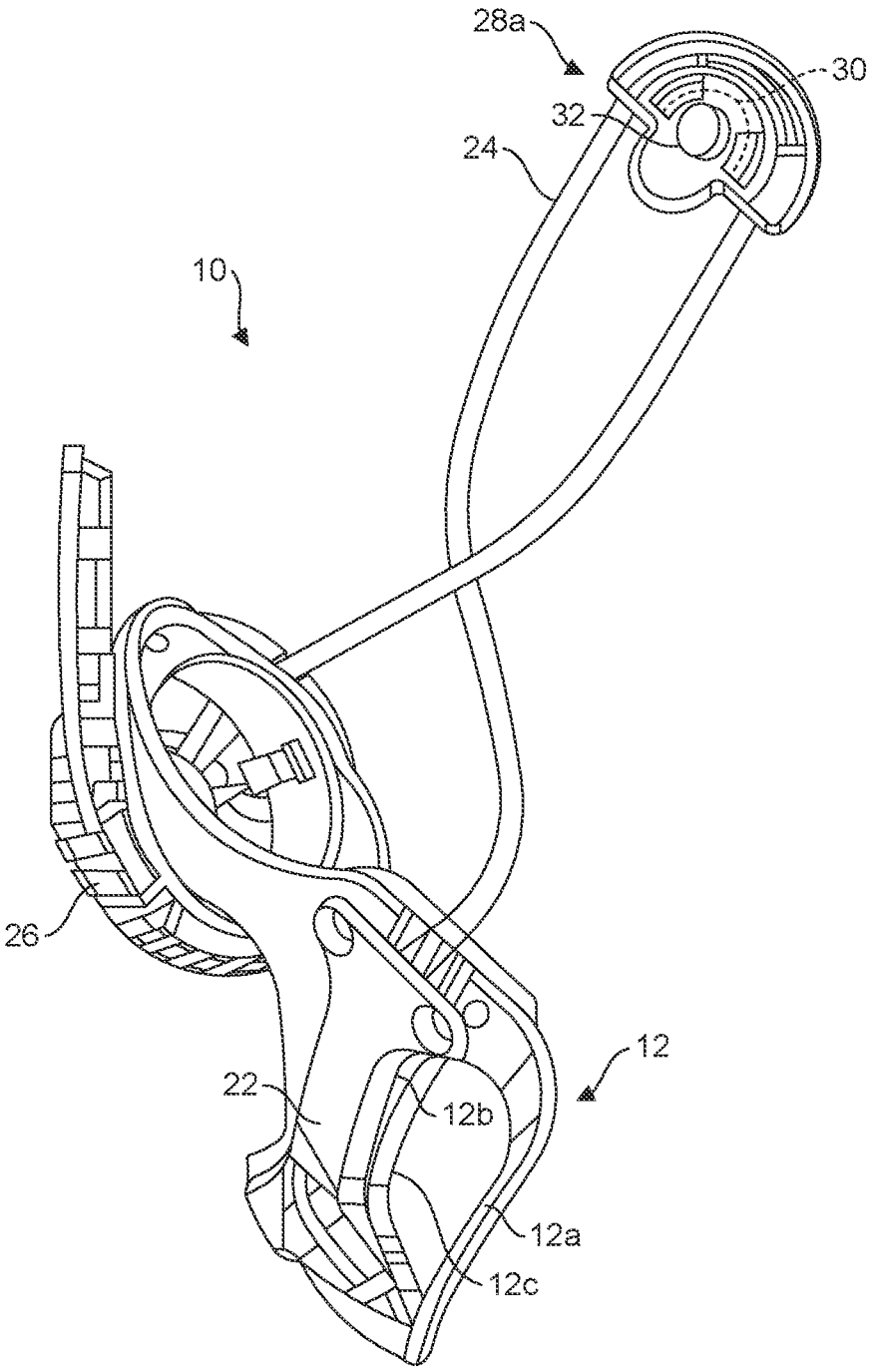
FIG. 4 is another side view of the helmet fit system in accordance with an embodiment of the present invention.
Figure 5:
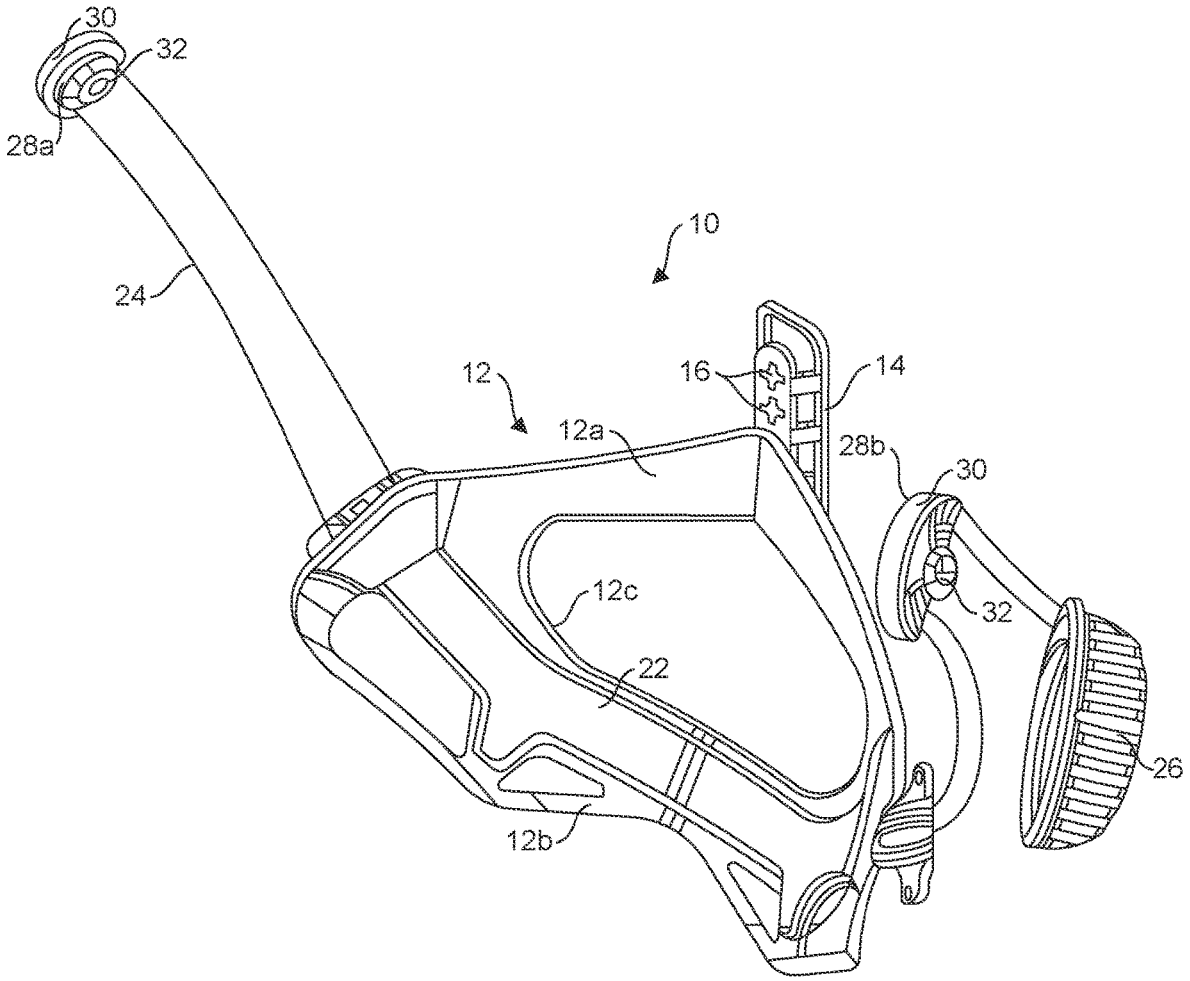
FIG. 5 is another side view of the helmet fit system in accordance with an embodiment of the present invention.

Referring to FIGS. 1 through 5, a helmet fit system 10 may include a harness 12. The harness 12 may be a set of webs or straps that are intended to cradle the rear of a person's head when wearing a helmet. In the illustrated embodiment, the harness 12 includes an upper web 12*a* and a lower web 12*b* defining an opening 12*c* between them. There may be any number of webs defining any number of openings in order to conform to the head of the wearer and to provide breathability. The harness 12 may be made of semi-rigid plastic such that the harness is able to flex to conform to the head of a wearer but does not significantly stretch during use (e.g., stretches less than 2 percent in length during use relative to when harness 12 is not being worn). For example, the harness 12 may be made of nylon, polyvinyl chloride (PVC), acrylonitrile butadiene styrene (ABS), or other polymer.

The harness 12 may attach to a helmet at one or more points. In the illustrated embodiment, an attachment strip 14 secures to an inner rear surface of a helmet and defines a plurality of attachment points 16 arranged vertically. The harness 12 may include a barb 18 secured thereto, such as by co-molding. The barb 18 may be inserted into any of the attachment points 16 in order to attach the harness 12 to the helmet. The barb 18 may be removed in order to adjust the height of the harness 12 and may be configured such that the force required to remove is greater than the force required to insert within one of the attachment points 16. The vertical adjustability provided by the barb 18 and attachment points 16 is just one example of an adjustable attachment approach and any approach known in the art for attaching a harness 12 to a helmet may be used. In some embodiments, the harness 12 is non-removably attached at one or more points to the harness 12, such as by rivets, welding, or other attachment means.

The harness 12 may define a channel 20 extending across the harness 12 such that openings on either end of the channel 20 are separated along a generally horizontal path (e.g., within 15 degrees of horizontal) when worn. The channel 20 may be defined by a cover plate 22 secured to the harness 12, such as over the lower web 12*b*. The channel 20 may secure to the lower web 12*b* by means of welds, adhesive, rivets, or other fastening means. The lower web 12*b* may define two or more ridges such that the channel is defined between the ridges. Alternatively, one or more grooves may be defined in the lower web 12*b* such that channel 20 is defined between the cover plate 22 and the grooves.

The channel 20 defined between the cover plate 22 and lower web 12*b* may include a height and a width that are both at least twice a diameter of a cable 24 passing through the channel 20 along its entire length. As will be discussed below, two lengths of a cable 24 may pass through the channel 20 such that in at least one dimension, the channel 20 is at least three times the diameter of the cable 24. Alternatively, multiple channels 20 may be defined between the cover plate 22 and the lower web 12*b* (e.g., multiple grooves in the web 12*b* or three ridges extending between the cover plate 22 and the lower web 12*b*). In this case, each channel 20 may have a cross section that is greater than the diameter of the cable 24 in two orthogonal directions.

In some embodiments, end portions of the cover plate 20 may be secured to the web 12*b* by means of rivets or other fasteners 22*a*, 22*b*, 22*c*, 22*d* in order to one or both of reinforce the channel 20 and provide a rounded region at the left and right entry points to facilitate sliding of the cable 24.

The cable 24 may be tensioned by a tensioning assembly 26. The tensioning assembly may provide a mechanism to take up the cable 24 or pay out the cable 24 on order to adjust the relative position of the harness 12. For example, the tensioning assembly 26 may be a BOA (Boa Technology, Inc.) tensioning system providing a ratcheting dial used to take up cable that may then be released to permit paying out of the cable 24. Any dial tensioning system known in the art may also be used. As is apparent in FIGS. 1 and 2, the tensioning assembly 26 is not secured to the harness 12. Instead, as discussed below, the tensioning assembly 26 secures to a helmet shell independently of the harness 12 such that movement and adjustment of the harness 12 does not change the position of the tensioning assembly 26 on the helmet.

The cable 24 may further be routed around anchors 28*a*, 28*b* fastened to the harness to the left and right of the harness 12. By adjusting the length of the cable 24, the position of the harness 12 relative to the anchors 28*a*. The anchors 28*a*, 28*b* may be mounted such that they are vertically above the outlets of the channel 20 when the helmet is worn and the wearer's face is looking straight ahead. In this manner, the horizontal and vertical position of the harness 12 may be adjusted.

The anchors 28*a*, 28*b* may be shaped as pulleys defining a rounded channel 30 that may be enclosed but for entry and exit points or may be open as a conventional pulley. The anchors 28*a*, 28*b* may define fastening points 32 in the form of openings sized to receive a rivet or other fastener. Alternatively, a fastener, e.g. a barbed rivet, may be integrally formed with each anchor 28*a*, 28*b*.

A first end of the cable 24 is secured within tensioning assembly 26. The cable 24 passes around anchor 28*a* and into the left entry point of the channel 20 in the harness 12. The cable 24 passes through the channel 20 and exits a right entry point of the channel 20. The cable 24 exits the channel 20 and passes around anchor 28*b*. The cable 24 passes from anchor 28*b* back into the right entry point of the channel 20. The cable 24 passes through the channel 20 and exits the left entry point of the channel 20. The cable 24 exits the left entry point of the channel 20 and extends around the anchor 28*a*. The cable 24 passes from anchor 28*a* back into the tensioning assembly 26 where a second end of the cable 24 is fastened.

The tensioning assembly 26 may apply tension to both ends of the cable 24. Both end portions 24 of the cable 24 are taken up simultaneously. Alternatively, a first end of the cable 24 may be fixed to the tensioning assembly 26 or to an area of a helmet adjacent the tensioning assembly (e.g., within 1 cm) such that only an end portion including the second end is taken up by the tensioning assembly 26.

Figure 6:
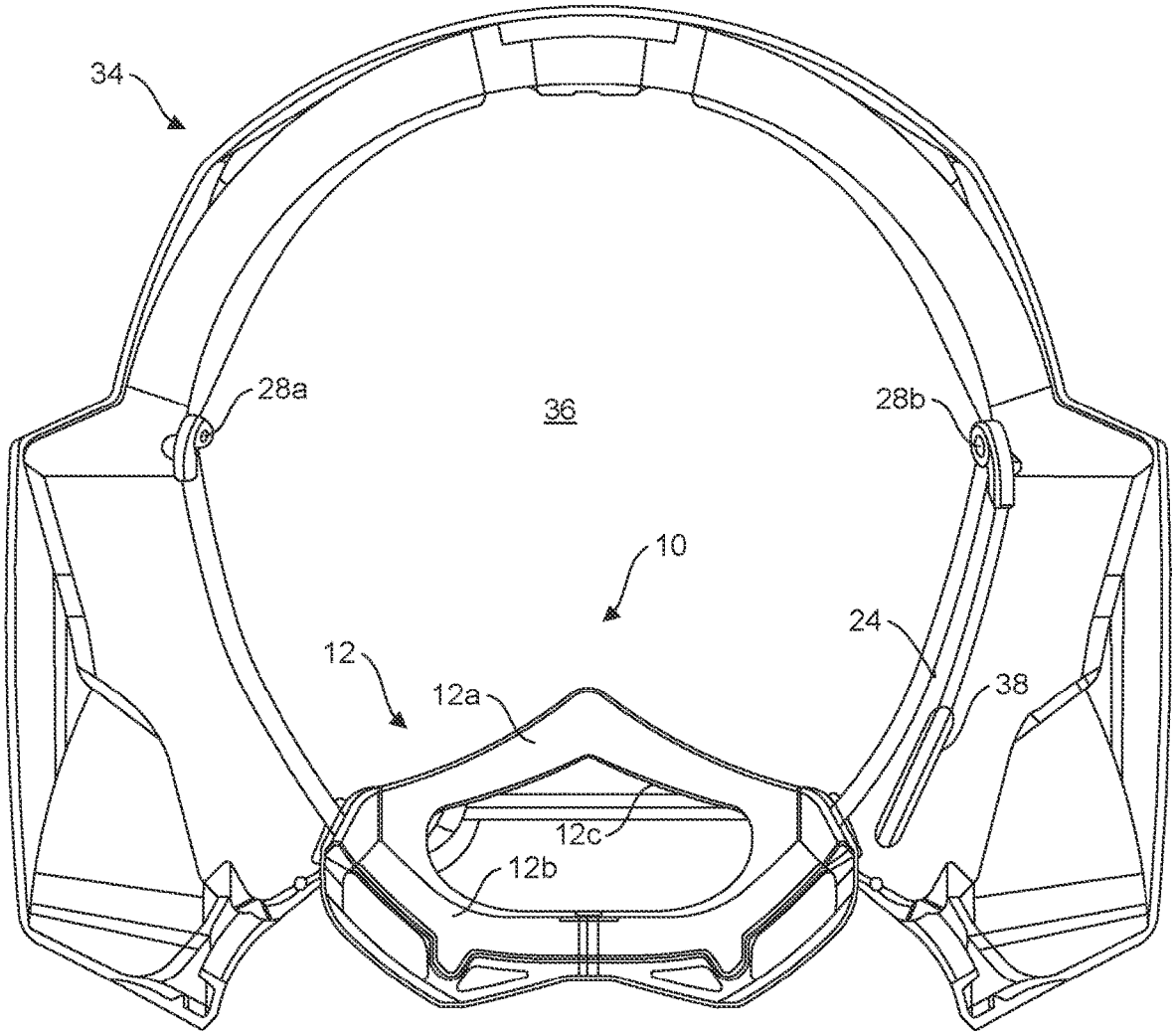
FIG. 6 is a view of the interior of a helmet incorporating the helmet fit system in accordance with an embodiment of the present invention.
Figure 7:
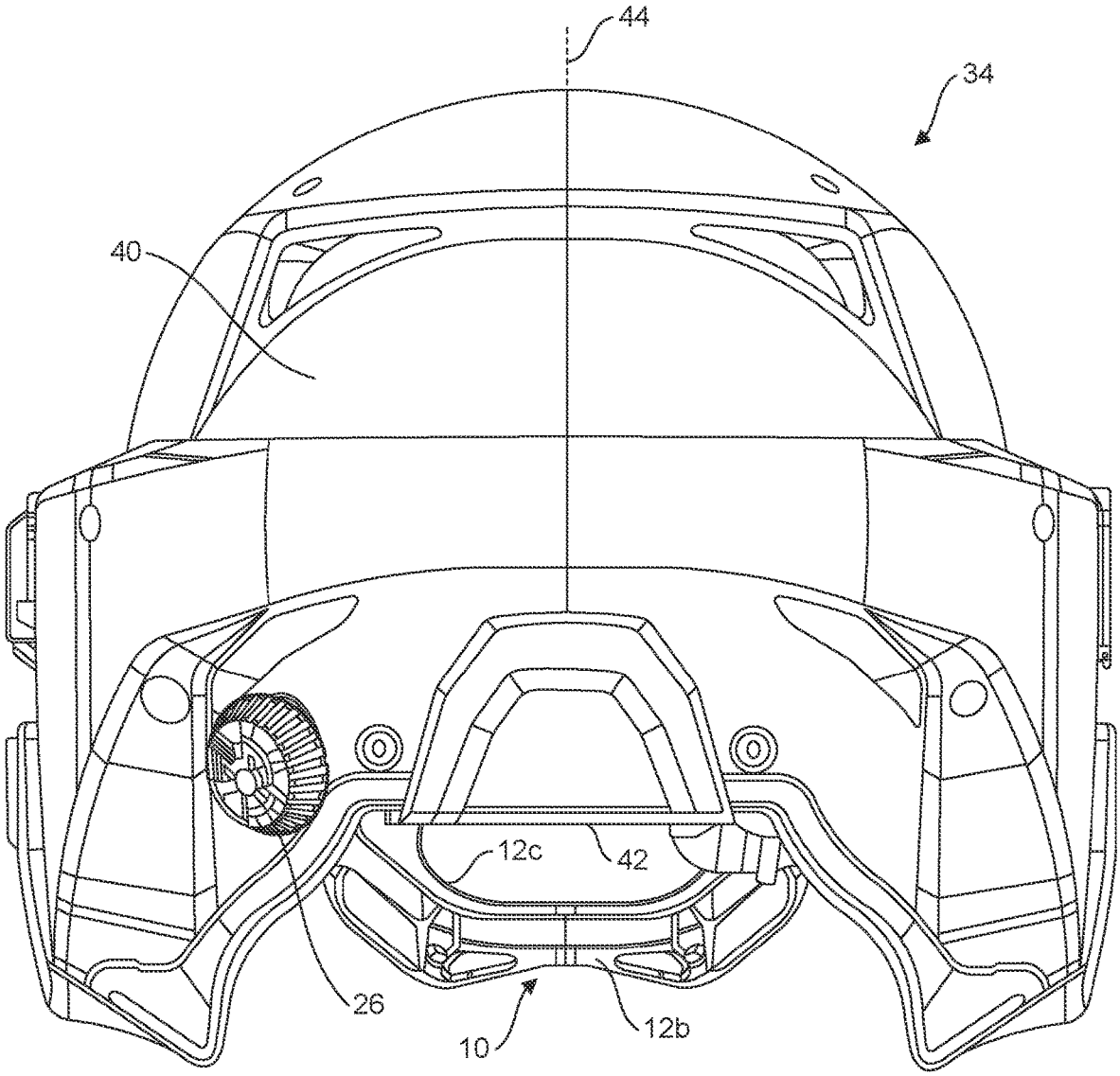
FIG. 7 is a rear view of a helmet incorporating the helmet fit system in accordance with an embodiment of the present invention.

FIGS. 6 and 7 illustrate an example helmet 34 incorporating the helmet fit system 10. The harness 12 may be positioned within the helmet 34 having the anchors 28*a*, 28*b* secured to the helmet 34 over an inner surface 36 of the helmet 34. The anchors 28*a*, 28*b* may be positioned forward of the harness 12 and possibly above the anchors 28*a* 28*b* in use. The cable 24 is arranged as described above. The tensioning assembly 26 is positioned outside of the helmet and protrudes from, and may be secured to, an outer surface 40 of the helmet. Accordingly, the helmet may define a channel 38 between the inner surface 36 and the outer surface 40. One or more lengths of the cable 24 may pass through this channel 38 to span between the anchor 28*b* and the tensioning assembly 26. Where only one end portion of the cable 24 is taken up by the tensioning assembly 26, one end of the cable 24 may be fastened to an anchor on the inner surface 36 such that only one length of the cable 24 passes through the channel 38.

In the illustrated embodiment, the harness 12 extends below a lower rear edge 42 of the helmet 34 during use for at least some of the vertical positions of the harness 12. As noted above, the attachment strip 14 may secure to the inner surface 36 of the helmet 34 and provide multiple attachment points for the harness 12.

As is apparent, the tensioning assembly 26 is not centered laterally on the helmet 34 such that the tensioning assembly 26 may be easily accessed while the helmet 34 is worn. This contrasts to conventional approaches where a tensioning dial is mounted to the harness 12 and is not accessible while the helmet is worn, particularly where the wearer may be in a small cockpit or wearing gear that constrains movement. For example, considering a plane of symmetry 44 of the helmet 34 bisecting left and right sides of the helmet. The plane of symmetry may be defined independent of non-symmetrical features on the helmet, e.g. the channel 38 or other features present on one side but not on the other. The tensioning assembly 26 may be offset from this plane of symmetry 44 by at least 15 percent, preferably at least 20 percent, and more preferably at least 25 percent, of the width of the helmet perpendicular to the line of symmetry 44.

While the preferred embodiment of the invention has been illustrated and described, as noted above, many changes can be made without departing from the spirit and scope of the invention. In particular, a mirror configuration of the helmet fit system 10 is possible, such as to accommodate both left handed and right handed wearers. Accordingly, the scope of the invention is not limited by the disclosure of the preferred embodiment. Instead, the invention should be determined entirely by reference to the claims that follow.

I claim:

1. A helmet fit system for mounting in a helmet comprising:

a harness;

a first anchor;

a second anchor;

a tensioning mechanism; and a cable passing from a first point of securement on the tensioning mechanism, around the first anchor, through the harness, and around the second anchor;

wherein the tensioning mechanism is not secured to any portion of the harness; and wherein the cable further passes from the second anchor, back through the harness, around the first anchor to a second point of securement on the tensioning mechanism.

2. The helmet fit system of claim 1, wherein the harness defines a channel, the cable passing through the channel.

3. The helmet fit system of claim 2, wherein the channel is defined by a cover plate secured over a portion of the harness.

4. The helmet fit system of claim 1, wherein the tensioning mechanism is a dial tensioner.

5. The helmet fit system of claim 1, wherein the harness is adapted to conform to a head of a wearer of the helmet.

6. The helmet fit system of claim 1, wherein the harness defines a plurality of webs defining one or more openings.

7. The helmet fit system of claim 1, further comprising a fastening strip defining a plurality of fastening points, the harness being configured to secure to any of the fastening points.

8. A system comprising:

a helmet adapted to secure around a head of a wearer and having an inner surface and an outer surface, the helmet defining a plane of symmetry; and a helmet fit system mounted to the helmet, the helmet fit system including:

a harness;

a first anchor mounted to the inner surface of the helmet on a first side of the plane of symmetry;

a second anchor mounted to the inner surface of the helmet on a second side of the plane of symmetry opposite the first side;

a tensioning mechanism mounted to the outer surface of the helmet on the first side of the plane of symmetry; and a cable passing from a first point of securement on the tensioning mechanism, around the first anchor, through the harness, and around the second anchor;

wherein the helmet defines a channel defined between the inner surface and the outer surface and offset from the plane of symmetry, the cable passing from the first point of securement on the tensioning mechanism, through the channel, and around the first anchor.

9. The system of claim 8, wherein the cable further passes from the second anchor, back through the harness, around the first anchor, through the channel, and to a second point of securement on the tensioning mechanism.

10. A system comprising:

a helmet adapted to secure around a head of a wearer and having an inner surface and an outer surface, the helmet defining a plane of symmetry; and a helmet fit system mounted to the helmet, the helmet fit system including:

a harness;

a first anchor mounted to the inner surface of the helmet on a first side of the plane of symmetry;

a second anchor mounted to the inner surface of the helmet on a second side of the plane of symmetry opposite the first side;

a tensioning mechanism mounted to the outer surface of the helmet on the first side of the plane of symmetry; and a cable passing from a first point of securement on the tensioning mechanism, around the first anchor, through the harness, and around the second anchor;

wherein the tensioning mechanism is offset from the plane of symmetry by at least 15 percent of a width of the helmet perpendicular to the plane of symmetry.

11. A system comprising:

a helmet adapted to secure around a head of a wearer and having an inner surface and an outer surface, the helmet defining a plane of symmetry; and a helmet fit system mounted to the helmet, the helmet fit system including:

a harness;

a first anchor mounted to the inner surface of the helmet on a first side of the plane of symmetry;

a second anchor mounted to the inner surface of the helmet on a second side of the plane of symmetry opposite the first side;

a tensioning mechanism mounted to the outer surface of the helmet on the first side of the plane of symmetry; and a cable passing from a first point of securement on the tensioning mechanism, around the first anchor, through the harness, and around the second anchor;

wherein the tensioning mechanism is offset from the plane of symmetry by at least 20 percent of a width of the helmet perpendicular to the plane of symmetry.

12. The system of claim 8, wherein the harness defines a channel, the cable passing through the channel.

13. The system of claim 12, wherein the channel is defined by a cover plate secured over a portion of the harness.

14. The system of claim 8, wherein the tensioning mechanism is a dial tensioner.

15. The system of claim 8, wherein the harness is adapted to conform to a head of a wearer of the helmet.

16. The system of claim 8, wherein the harness defines a plurality of webs defining one or more openings.

17. The system of claim 1, further comprising a fastening strip defining a plurality of fastening points secured to the inner surface of the helmet, the harness being configured to secure to any of the fastening points.

18. The system of claim 8, wherein the tensioning mechanism is not secured to harness by any structure other than the cable and the helmet.

* * * * *